United States Patent [19]

Straubinger

[11] Patent Number: 4,704,939

[45] Date of Patent: Nov. 10, 1987

[54] TONE HOLE PAD FOR WIND INSTRUMENTS, PARTICULARLY FLUTES

[76] Inventor: David Straubinger, 2521 E. Southport Rd., Indianapolis, Ind. 46227

[21] Appl. No.: 791,513

[22] Filed: Oct. 25, 1985

[51] Int. Cl.[4] ..... G10D 9/04

[52] U.S. Cl. ..... 84/385 P

[58] Field of Search ..... 84/385 P

[56] References Cited

U.S. PATENT DOCUMENTS

| | | | |
|---|---|---|---|
| 1,621,395 | 3/1927 | Ciccone | 84/385 P |
| 1,635,775 | 7/1927 | Arthur | 84/385 P |
| 1,681,220 | 8/1928 | Ciccone | 84/385 P |
| 1,716,848 | 6/1929 | Bond | 84/385 P |
| 1,728,553 | 9/1929 | Klingler | 84/385 P |
| 1,918,506 | 7/1933 | Weeks | 84/385 P |
| 2,292,767 | 8/1942 | Page | 84/385 P |
| 2,540,760 | 2/1951 | Schoemann | 84/385 P |
| 3,501,991 | 3/1970 | Carruthers et al. | 84/385 P |
| 3,688,633 | 9/1972 | Nagao | 84/385 P |
| 3,691,892 | 9/1972 | Matsuura et al. | 84/380 R |
| 4,158,979 | 6/1979 | Suzuki | 84/385 P |
| 4,508,004 | 4/1985 | Pages | 84/385 P |

FOREIGN PATENT DOCUMENTS

| | | | |
|---|---|---|---|
| N246255 | 4/1926 | Italy | 84/385 P |
| 384788 | 12/1932 | United Kingdom | 84/385 P |

OTHER PUBLICATIONS

"Understanding the Complicated Process of Making Flute Pads Work" by Ross Prestia, pub. by National Flute Assoc. Newsletter, Nov. '83, c/o Myrna Brown, 805 Laguna Dr., Denton, Tex. 76201.

"The Complete Guide to the Flute from Acoustics and Construction to Repair and Maintenance" by James Phelan and Mitchell D. Brady, pub. by Conservatory Publications, Boston, 1980, (Chapter 7 particularly pertains to "Padding, Corks, Felts and Adjustment).

*Primary Examiner*—Lawrence R. Franklin

*Attorney, Agent, or Firm*—Zalkind & Shuster

[57] ABSTRACT

A tone hole pad comprises a rigid backing disc but having a bendable margin and has at one face a recess between inner and outer coaxial collars to accommodate a cushion ring. Stretched across the radial faces of the collars and backed by the cushion ring is a membrane or skin as a sealing surface means that folds around the periphery of the rigid backing disc and is secured at the opposite face and is limited to a ringlike area. The support of the skin in a limited ringlike area on concentric collars effects a stability to resist and minimizes shrinkage or expansion, under ambient conditions, of the sealing surface that causes leakage. The periphery of the backing disc in one form of the invention is grooved to accommodate a tool for bending or marginally deforming one side of the disc to close leakage gaps caused by uneven contact on the rim of a tone hole. In a preferred form of the invention a similar but grooveless disc is backed by a non-bendable rigid disc. To compensate for leakage, partial shims are placed between the two discs in an area where leakage has been detected. By a wedging action a bending at such area of the bendable disc to close the leakage gap between the skin and a tone hole seat is effected by forcing the discs together, with the non-bendable rigid disc being supported by the pad cup to resist movement.

25 Claims, 14 Drawing Figures

TONE HOLE PAD FOR WIND INSTRUMENTS, PARTICULARLY FLUTES

BACKGROUND OF THE INVENTION

Various tone hole pads for wind instruments have been long known.

The prior constructions have drawbacks. The constructions are not conducive to maintaining a flat sealing surface against a tone hole nor to minimize expansion or shrinkage when exposed to weather changes or stage lights nor to seal around the tone hole seat with a very light touch of the key nor to maintain a uniformity of contact in a poorly designed or bent pad cup.

While the pads of the known art vary greatly in construction they fail to overcome the known problems in maintaining a long lasting sealing effect over a period of time when subjected to adverse conditions.

Considerable information on the problems and technology of the art is found in the following publications:

Understanding the Complicated Process of Making Flute Pads Work, published in the November 1983 Newsletter of the National Flute Association (Vol. IX, no. 1), written by Ross Prestia and published by the National Flute Association Newsletter, c/o Myrna Brown, 805 Laguna Drive, Denton, Texas 76201.

The Complete Guide to the Flute from Acoustics and Construction to Repair and Maintenance, by James Phelan and Mitchell D. Brady, published by Conservatory Publications, Boston, 1980. (Chapter 7 particularly pertains to "Padding, Corks, Felts and Adjustments").

The art heretofore known utilizes partial shims of thin material in the pad holding cup of the key arm to compensate for air leaks between the pad skin surface and the seat of the tone hole. No pad hitherto known is constructed so as to be bendably adjustable for leaks. Pads will pull the cardboard backing of the pad away from the back of the cup if the skin shrinks. Also, shrinking of the skin causes the outer edge of the cushion to be drawn in, causing leakage.

Thick cardboard backing may be used to minimize warping of a pad, as is used in students' flutes, but such constructions cannot be carefully leveled to the tone hole seat. Also, the problem still remains of the skin drawing the outer edge of the cushion away from the edge of the pad cup thus causing leaking. These problems cause the pad surface to no longer be in a flat plane.

As will be apparent from what follows, the warping problems and leakage are eliminated in my invention by recessing the cushion in a backing member and stretching the skin over the cushion with support on coaxial collars so that the cushion is essentially flat despite any shrinking of the skin.

BRIEF DESCRIPTION OF THE PRESENT INVENTION

The invention herein uses a novel metal backing disc having a peripheral collar and a coaxial central collar with the radial faces of the collars in the same plane and a recess in the face of the disc between the collars for accomodating a cushion. A seating skin is stretched across the cushion and collars and folded around the sides of the disc and over the other side of the disc for conventional gluing.

The collars lend support to the skin to keep it substantially flat against a preferably thin cushion of ultrasuede. Applying the skin to the disc can be conventional. In any event, the construction is completed with a screw through the center collar which clamps a washer against the skin and the radial face of the center collar. For an open hole French type a retainer ring is used. The overall construction effects a stabilization of the skin which prevents warping.

As will be understood from the description to follow, various modifications are constructed with a rigid backing plate spaced from a plate bendable in marginal areas utilizing the rigid plate as a reaction support to take the stress of bending of the bendable plate at a selected marginal area to close a leakage air gap.

Modifications which utilize partial shims to effect such bending are a preferred form of the invention.

A particular feature of the invention resides in providing a peripheral groove in the edge of the backing disc, so positioned between the faces of the disc that the skin side of the disc is thinned to render it bendable by a lever inserted into the groove. The amount of bending is governed by the amount of leakage to be overcome as determined by conventional methods using feeler gauges, sometimes mere pieces of paper. Having ascertained the amount of bending needed at some particular point or area, index marks are made on the pad to show the leakage area. Corrections are then made in a simple manner removing the pad from the pad cup and placing it in a holder. A lever having a pin tip is then used to pierce the skin in one or several adjacent points and penetrate into the groove. With the use of a micrometer mounted to the holder the lever is used to bend the thinned skin side of the backing disc a requisite distance according to the feeler gauge measurements to compensate for the air leakage gap. Thus, an accurately and easily produced correction is effected.

The invention is also applicable for hole pads of the French type, although in such use there would be no center screw securing the pad to the cup, the usual friction held retainer then presses the skin to the central collar.

A detailed description of the invention now follows in conjunction with the appended drawing in which.

Figure 6A:
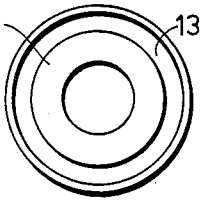
Figure 6B:
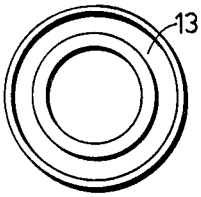

FIGS. 6*a* and 6*b* show relative hole sizes for a standard and a French type of pad, respectively.

Figure 7:
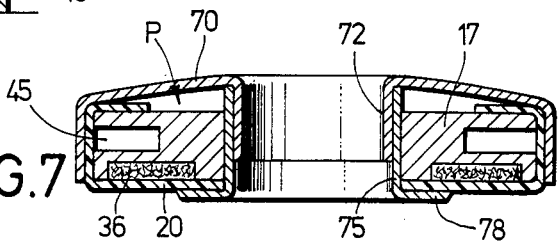

FIG. 7 is an exploded section of the pad cup and retainer ring of conventional construction for securing a pad of the invention of the French type.

Figure 8:
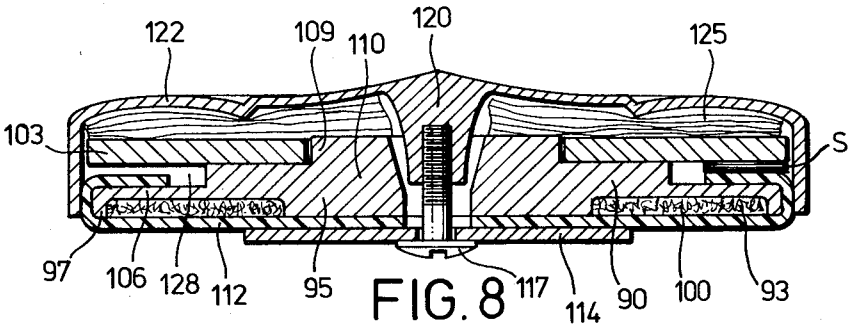

FIG. 8 shows a vertical section through a preferred form of the invention for a standard pad wherein an economy is effected by eliminating the need for a micrometer.

Figure 9:
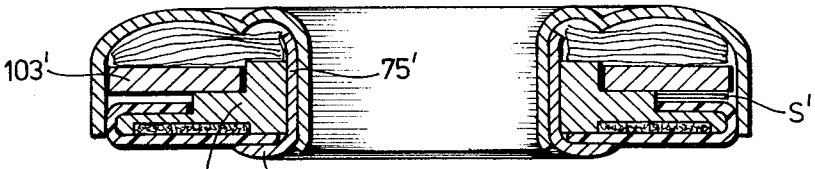

FIG. 9 shows a vertical section of the form of FIG. 8 modified for a French type pad.

Figure 10:
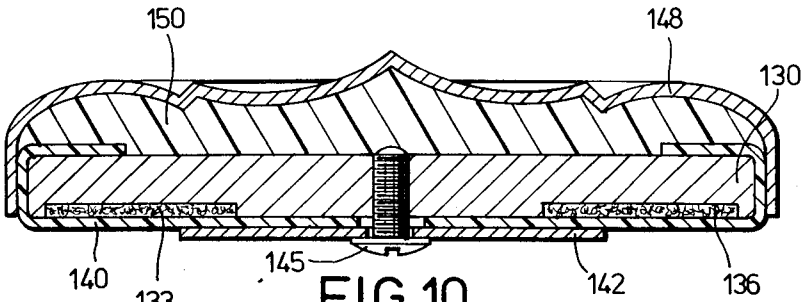

FIG. 10 shows a vertical section through a standard pad of another form of the invention having no adjustment for leakage but preserving the advantage of a narrow ringlike skin area.

Figure 11:
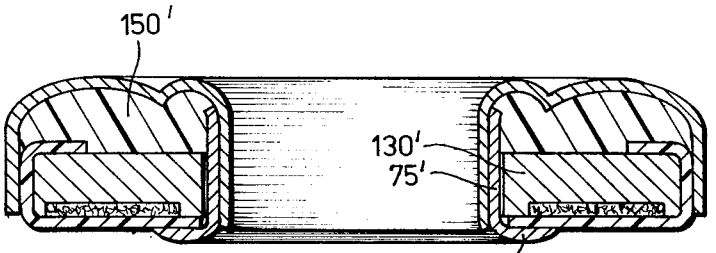

FIG. 11 shows the form of FIG. 10 modified for a French type pad.

Figure 12:
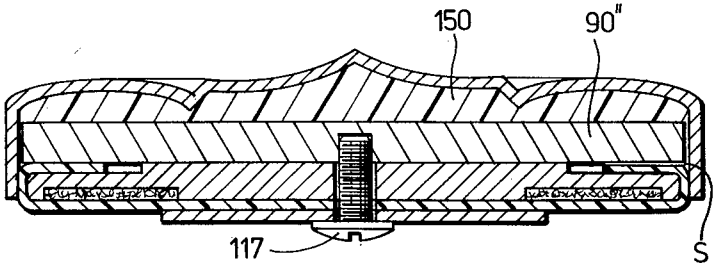

FIG. 12 shows a combination of FIGS. 8 and 10.

Figure 13:
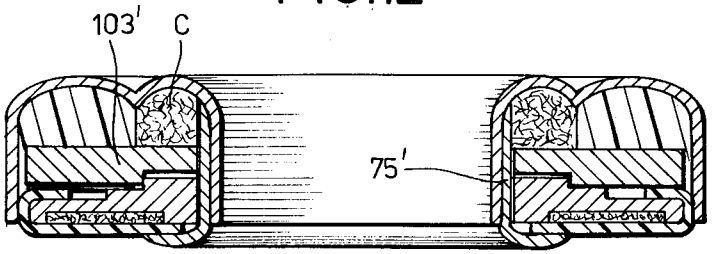

FIG. 13 shows a combination of FIGS. 9 and 11 somewhat modified to prevent leakage of melted glue.

Figure 1:
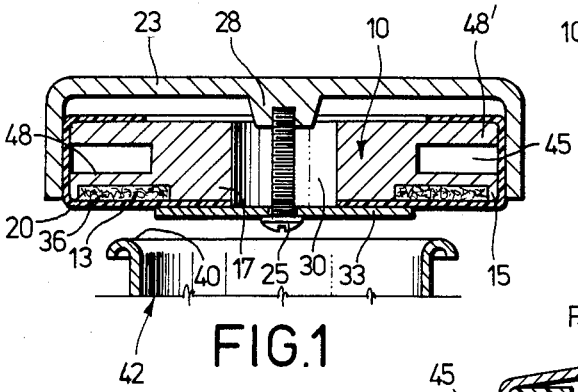
FIG. 1 shows a greatly magnified vertical section through a pad of the invention in a pad cup, with grooved backing disc.

Referring to FIG. 1, the pad P comprises an aluminum backing disc 10, a ringlike recess 13 intermediate a peripheral rim or outer collar 15 and a coaxial central or inner collar 17. A skin 20 of conventional material such as gold beater skin or zephyr skin is disposed across the radial faces of the collars and peripherially folded around the backing disc to be inwardly folded over the upper side and secured as by gluing. Double skin layers are sometimes used.

The assembly thus described is secured to a pad cup 23 as by a screw 25 having an end threaded into the cup boss 28 in the usual manner, passing through a central bore 30 in the backing disc. However, the other end of the screw is chamfered, as shown, engaging in the aperture of a washer 33 that presses the usual central aperture of the skin marginally against the radial face of the inner collar. The radial faces of the collars are in the same plane and the skin is backed by a ringlike cushion 36 of ultra-suede material in recess 13.

Thus, the skin is maintained substantially flat with cushion backing support to limit indentation by the sealing contact pressure against the tone hole seat 40 of tone hole 42, understood to be closed by the pad in an air tight manner. Further, by providing for pad flatness there is resistance to shrinking which aids in the stabilization of the pad surface so that uniformity of air tight operation is realized with the flatness provided by the support collars 15 and 17 of the rigid backing ring. The backing ring is made of a ductile metal such as aluminum for a purpose as described hereinafter.

Thus, the rigid backing disc utilizing the coaxial collars with a thin cushion material, such as ultrasuede, retains flatness of the skin against shrinkage which can cause warping of cardboard shims in prior art constructions. Skins not provided with means for maintaining flatness and particularly constructions that use thick cushions which are spongy do not have a precise contact with a tone hole seat.

Also, the inner collar prevents compression of the skin and cushion which would cause warping of cardboard shims by stretching the skin too tightly, distorting the sealing surface of the skin and causing leakage in prior art constructions.

The space between the collars is narrowed by the width of the inner collar. This assists in uniformity of sealing contact as compared with the wide unsupported skin areas of the prior art. A narrow skin area is proportionately less subject to contraction or expansion with temperature and humidity conditions and hence more reliable in maintaining proper tautness.

The washer 33 extending beyond the inner collar 17 helps to stabilize the skin by compressing it against the cushion around its inner margin.

An important feature of the invention resides in providing the backing disc 10 with a peripheral groove such that the disc at the recess has a thinned side 48, thinned to make it readily bendable in a manner to be described for eliminating air leakage between skin 20 and a tone hole seat 40. The relatively thick and rigid side 48′ serves as a reaction support during bending of side 48.

Figure 2:
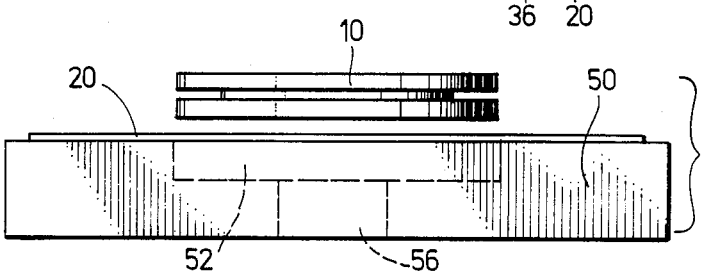
FIG. 2 shows a conventional first step in assembling the pad.
Figure 3:
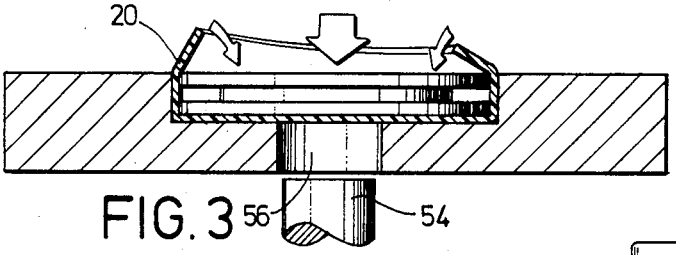
FIG. 3 shows a conventional second assembly step.

Preliminarily, however, FIGS. 2 and 3 illustrate that assembly of the pad of the invention is along conventional lines. Thus, FIG. 2 illustrates a fixture 50 having a recess 52 as shown in dotted lines to accommodate a backing disc 10 of the invention with a cushion 36 therein, superimposed on skin 20 of goldbeater skin or zephyr skin, or the like, laid across the recess.

The backing disc is then pressed into the recess, the skin being thus wrapped around the backing disc and folded over to be glued as understood from FIG. 3. After gluing, a rod 54 is pushed through a bore 56 of the fixture aligned with bore 30 of the backing disc to push the pad assembly out of the fixture. An aperture is cut in the skin for receiving a screw such as 25.

It will be noted that the exposed skin 20 is limited to a ringlike area by the space between the inner and outer collars which defines the recess 13 and by the overhang of washer 33 which compresses an inner circular margin of the skin against cushion 36. The ringlike area is thus limited to minimize shrinking and expansion effects of ambient conditions.

Due to pressure of the washer on inner collar 17 a tighter seal on the radial area of the inner collar is ensured.

Figure 4:
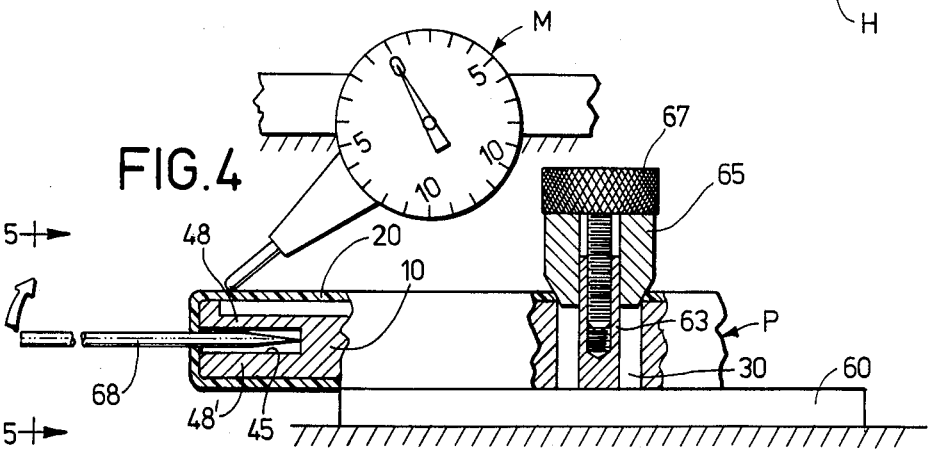
FIG. 4 shows the arrangement for bending a side of the backing disc of the bending assembly by means of a tool in the groove of the backing disc, using a micrometer.

Referring now to FIG. 4, the method of adjusting to correct for leakage is illustrated wherein a holder 60 has an internally threaded post 63 encompassed by a tapered retainer 65 pressed by a knurl head bolt 67 threaded into the post for securing a pad, inverted, in position on the holder with the thinned side 48 of the backing disc 10 uppermost. Thus, the retainer protrudes into the bore 30 for clamping the pad in position to expose an edge for entry of a bending tool 68 having a pointed tip for piercing the skin 20 to enter the groove. The tip is strong enough to act as a manual lever fulcrummed in the groove so that when the tool is pulled upwardly in the direction of the arrow, the thinned side 48 will bend upwardly.

A lever type micrometer M is mounted so that the lever extends to an area on the skin where contact is made with a tone hole seat. It is assumed that the amount of leakage gap has been determined by the use of suitable gauges all as is well known and described in the publications hereinabove disclosed. Accordingly, the bending is carried out to the proper extent by observation of the micrometer.

Figure 5:
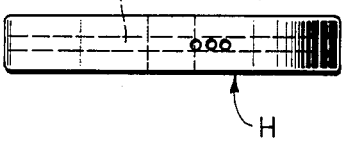
FIG. 5 illustrates a leak corrected pad showing puncture marks through the skin opposite the groove.

One or more closely spaced positions may be utilized depending on the leakage area, as indicated in FIG. 5, showing a pad with three punctures H through the membrane opposite the groove.

Further, the collars and washer stabilize the area of the skin for uniformity of surface and preservation of proper flatness. Although the cushion being generally thicker than the depth of the recess some slight surface curvature does occur, in the form of the invention later described in FIGS. 10 and 11, I have found that a cushion of a particular material can be cut to the exact depth of the recess. In any event for practicality of illustration the skins in all modifications herein are shown flat.

FIG. 6(*a*) shows an enlarged view of a backing disc for a standard type of flute showing the substantially large radial area of the inner collar to narrow the ringlike recess between the inner and outer collars 17 and 15, respectively. This results in a relatively narrow ringlike area of skin which is not rigidly supported by the collars but by a cushion and with less exposed area to be affected by climactic conditions. Of course, the exposed area must be sufficiently large to permit some variation in tone hole seat diameters yet remain within limits to take advantage of a narrowed area.

FIG. 6(*b*) shows an enlarged view of a backing disc for French type flutes; here again it can be seen that the inner collar is widened to narrow the recess and thus the area of skin that would be supported only by a cushion.

FIG. 7 illustrates a French flute backing disc wherein a retainer ring fits frictionally inside the inner collar and has a flange that clamps the skin marginally to the radial face of the inner collar. Thus, like reference numerals pertain to the same elements as in FIG. 1. However, the pad cup 70 has a reentrant collar 72 and the backing disc 10 nests inside the cylindrical walls of the cup leaving radial space for a retainer ring 75 frictionally gripping the inner wall of the reentrant collar to hold the pad in the pad cup. The retainer ring has radial flange 78 clamping skin 20 to inner collar 17 and extending beyond the inner collar. The internal diameter of the retainer ring is sized to securely grip within the bore of backing disc 10 so as to ensure the skin clamping effect.

Wind instruments and flutes vary in size as do tone holes and pads and dimensions for pads of the invention would vary accordingly. However, for one size of standard flute I have found the following dimensions in inches suitable for an aluminum backing disc, namely, a radius of 0.336 with a groove depth radially of 0.080 having an axial width of 0.030; the thinner lower side of the backing disc being 0.010 and the upper side being twice as thick, 0.020; the recess in this instance being 0.018 to accommodate a particular cushion of one layer of ultra-suede 0.035 thick, the inner collar being 0.120 thick and the outer collar 0.010. The thickness of the inner collar limits the area of the skin and increases the radial clamping surface for the skin. The bore for the screw is 0.272. The periphery of the backing disc has a suitable 2° taper to facilitate removal from a pad cup without undue friction against the cup sides.

The outer collar which is a peripheral flange of the backing disc could be varied in thickness to have a narrowing of the recess effect, providing a reasonable area of sealing contact allowing for tone hole variations is afforded, and further provided that increase of thickness does not make marginal bending too difficult.

The radial length of the exposed area of the skin beyond the extended washer would be variable depending on other dimensions, but of the order of 0.130.

All dimensions are generally proportional, as required for standard flutes, although for French types, wherein no screw is used, the bore would be larger, e.g., 0.370 and the inner collar scaled down in thickness, accordingly.

It will, of course, be understood that dimensions are variable to suit modifications of the invention and variations in tone hole sizes just so that the recessed side of the backing disc is conveniently bendable by an easily manipulated bending tool a few inches in length and that modifications wherein the backing disc is grooveless have cross sectional thickness that permit bending as further taught herein, for the purpose of the invention.

In any event, the arrangement is preferably such that the area centrally of the skin exposed from the inside edge of the outer collar to the rim of the washer be the area of contact with the tone hole seat, as shown in figures of the drawing.

Referring now to FIG. 8, a form of the invention, a pad, is shown which comprises a bendable backing disc 90 similar to that shown in FIG. 1 having a recess 93 between inner and outer collars 95 and 97, respectively. In this instance however, an unconventional cushion 100 equal in thickness to the depth of the recess is used, to be later described.

A rigid means in the form of a non-bendable disc 103, engages the bendable disc and buttresses the bendable disc to limit the bending of the bendable disc to the thinned margin 106. Disc 103 has a central aperture 109 encompassing collar 95 to centrally position disc 103 on central boss 110 of disc 90. A skin 112 envelops the bendable disc in the manner heretofore described, clamped by washer 114 and screw 117 to pad nut 120 of pad cup 122.

The discs are tightened by the screw against the interior wall of the pad cup through an intermediate spacer such as paper rings 125.

Annular recess 128 is provided on the inner face of the bendable disc 90 to accommodate the folded over skin between the discs.

When a leakage point is detected, it is gauged as by the pieces of paper of the order of 0.001 thickness or less, in a conventional fashion and the position noted with respect to disc 90. Then one or more partial shims as illustrated at S, equal to the amount of bending to be imparted to the thinned margin 106 are inserted between disc 103 and margin 106 in the unassembled disc at the noted point of leakage. The discs are then reassembled with the partial shim or shims over the point of leakage and screw 117 tightened. The inserted partial shim or shims effect a wedging action between the discs wherein the non-bendable disc 103 remains flat, but the bendable disc 90 is bent marginally downward to a degree to close the leakage gap.

The general dimensions for the bendable disc may be as previously described for FIG. 1, due regard being had that the thickness of the non-bendable disc be suitable for rigidity, to serve as a reaction support during bending of the thin margin 106 of disc 90.

Referring now to the cushion 100, a severable material sold under the registered trademark of SCOTT-FELT has been found to be advantageous. This material is manufactured by Scottfoam Corporation of Eddystone, Pa., and is a compressed urethane foam made from a reticulated polyester polyurethane open-pore foam having various characteristics, particularly for purposes herein, abrasion resistant and is a homogenous material. A mfrs. grade 900C has been found suitable.

A special feature of this material for flute pads is the ease of application, It can be cut into rings and glued in recesses such as 93 which would be of the order of 0.018 deep, but protruding considerably, being, e.g., 0.250 thick. The rings can then be manually razor sliced or severed flush or nearly flush with the radial surfaces of the collars 95 and 97. Possibly, the disc may be rotated in a lathe while the cushion is sliced. I have found that the material can be thinly sliced in a microtome.

Inasmuch as the cushion material described cannot be compressed in manufacturing to an exact thickness to match varying recess depths, nor can other cushion materials of which I am aware, be so accurately dimensioned, the improvement effected makes for an economy not otherwise possible. Accordingly, while no claim is made herein for the material per se as a flute pad cushion, I believe the method of manufacture of pads is novel with me as a matter of production.

I believe the cushions to be slicable to exact thicknesses by a special microtome or lathe type machine for production purposes.

Thus, rings of the material could be prepared for insertion in recesses 93 and cleanly severed, e.g., by rotating disc 90 with the cushion insert meeting a rotating blade.

Referring now to FIG. 9 for a French type flute, the same combination of bendable disc 90' and non-bendable disc 103' is illustrated as in FIG. 8 with a retainer ring 75' as in FIG. 7, the flange 78' being available to be tapped or pushed to effect the wedging action bending of disc 90' due to a partial shim or shims S', all as previously described.

Referring now to FIG. 10 for a standard flute, the assembly of the pad shown is not adjustable to compensate for leakage gaps, but a general leveling can be accomplished. In this instance, a non-bendable disc 130 has the recess 133 with a cushion 136 therein which may be of the cellular foam material 100 previously described in FIGS. 8 and 9, flush or nearly flush with the radial surfaces of the inner and outer collars, and skin 140, clamped by washer 142 and a screw 145 in this case threaded into disc 130, all as will be readily understood from the description heretofore set forth. However, for students' flutes a softer cushion could be used.

The assembly is secured inside pad cup 148 by conventional hot melt glue as commonly provided for glue guns. Leveling can be had by pressing the pad against a tone hole seat before the glue 150 solidifies, or by heating the pad cup.

Although this construction is not adjustable to close leakage gaps, it preserves the limited area stabilized skin ring to minimize shrinking and expansion, as will be readily recognized.

FIG. 11 shows the adaptation of FIG. 10 to a French type flute. From the description just given for FIG. 10, the assembly is secured inside a pad cup by a hot melt glue 150', or equivalent adhesive means.

In this instance, a retainer ring 75' and flange 78' as described in FIGS. 7 and 9 are used, to rigidify the disc 130' and skin assembly and as a spacer to position such assembly within the pad cup to ensure the ringlike skin area being placed for engagement witn a tone hole, all as will be readily understood from mere inspection of the related components of FIG. 11.

In FIGS. 8–11, the pad cups could, of course, be of simpler shape such as shown in FIGS. 1 and 7. Further, it will be appreciated that considerable liberty has been taken in the proportions of the figures of the drawing for purposes of clear illustration. As a practical matter, shims would in actuality be of the order of 0.001 or less, e.g., the shims S and S' of FIGS. 8 and 9, and having an arcuate area suitable to the conditions to be met, generally less than 90°. The paper rings could be of the order of 0.001 or thicker and a material such as cardboard or plastic sheet or film could be used. The invention in its various modes is not critical as to materials or dimensions except that aluminum is thought preferable to other disc materials because of lightness and ductility, due regard being had for the thickness of bendable marginal areas to ensure ease of bending without an need for undue force and with due regard for the need for support resistance rigidity of the unbendable support element, e.g., 48' or 103 and equivalents.

Various modifications can be made based on the teachings herein. For example, as seen in FIG. 12, a variation of the form shown in FIG. 8 is illustrated wherein instead of paper rings 125 (FIG. 8), or the like, a bed of hot melt glue 150, as shown in FIG. 10, could be substituted. In such case, the screw 117 would be threaded into a blind bore in disc 90'', no pad nut 120 being needed.

The same change could be made in FIG. 9 using hot melt glue instead of paper rings. In FIG. 13, to prevent melted glue from leaking downward through the retaining ring 75', the non-bendable disc 103' extends fully across disc 90' to encircle the retaining ring 75'. Isolating the glue mass from the retaining ring is a collar C of sealing material, e.g., SCOTTFELT, heretofore described, intermediate the glue mass and the retaining ring.

I claim:

1. A pad for closure of a wind instrument tone hole, comprising a backing disc having a peripheral groove extending into the edge thereof; one side of said disc having a sealing skin and being bendable out of its plane within a ringlike area determined by the depth of said groove and to a measurable extent by a tool insertable into said groove at a point predetermined by detection of a leakage gap between said sealing skin and a tone hole pad seat at said point;

whereby inaccuracy of closure between said pad and pad seat can be corrected by bending said one side at said point to correct leakage thereat.

2. A pad as set forth in claim 1, said one side of said disc having coaxial collars effecting a recess therebetween; a cushion in said recess; wherein said sealing skin extends across said collars with a ringlike area therebetween supported by said cushion; said ringlike area being limited to reduce shrinking and expansion of said skin subjected to ambient conditions.

3. A pad as set forth in claim 2, said ringlike area having a radial dimension of no more than half the radius of said disc.

4. A pad as set forth in claim 2, said ringlike area having a radial dimension less than half the radius of said disc.

5. A pad as set forth in claim 2, a bore through said backing disc within the innermost of said collars; and sealing skin having an aperture; means for securing said sealing skin to said collars comprising fastening means for fastening said pad to a pad cup, said fastening means extending into said bore, clamping said sealing skin to the radial face of said innermost collar marginally around said aperture in said sealing skin.

6. A pad as set forth in claim 5, said clamping means comprising a washer having a radius larger than the radius of the inner of said collars so as to extend into said ringlike area to stabilize said sealing skin against the radially inner margin of said cushion by clamping the radially inner area of said skin thereto.

7. A pad for closure of a wind instrument tone hole comprising a rigid backing member and including a bendable member having a sealing surface means and being of a material capable of permanent bending in a selected area of sealing contact of said sealing surface means with a tone hole seat at said selected area;

said rigid backing member being superimposed on said bendable member with a marginal spacing therebetween wherein an occurrence of an air leakage gap in the area of contact between said sealing surface means and a tone hole seat may be measured and said bendable member bent by being stressed by virture of reaction support of said rigid backing member at a selected marginal area of said spacing a correspondingly measured amount to close said gap.

8. A pad as set forth in claim 7, said bendable member being a marginally bendable disc having coaxial collars effecting a recess therebetween; a cushion in said recess; wherein said sealing surface means extends across said collars with a ringlike area therebetween supported by said cushion; the spacing between said collars limiting said cushion supported ringlike area of said sealing surface means to reduce shrinking and expansion of said sealing surface means subjected to ambient conditions.

9. A pad as set forth in claim 8, said ringlike area having a radial dimension of no more than half the radius of said marginally bendable disc.

10. A pad as set forth in claim 8, said ringlike area having a radial dimension less than half the radius of said marginally bendable disc.

11. A pad as set forth in claim 8, a bore through said marginally bendable disc within the innermost of said collars, said sealing surface means having an operative means for securement to said collars comprising a fastening member for fastening said pad to a pad cup, said fastening member extending into said bore, and having a clamping means for clamping said sealing surface means to the radial face of said innermost collar.

12. A pad as set forth in claim 11, said clamping means comprising a washer having a radius larger than the radius of the inner of said collars so as to extend into said ringlike area to stabilize said sealing skin against the radially inner margin of said cushion.

13. In a pad for closure of a wind instrument tone hole as set forth in claim 7, said rigid backing member and said bendable member being separate members so that said marginal spacing is variable to receive shim means of various thickness means for stressing said bendable member at a central portion towards said rigid member;

whereby shim means equal in thickness to a detected leakage gap may be placed in said marginal spacing intermediate said rigid member and said bendable member at an area of leakage so that stressing said bendable member effects selective bending of said bendable member towards a tone hole in the area of said shim means, by wedging action of said shim means, to close said gap.

14. In a pad for closure of a wind instrument tone hole as set forth in claim 13, said bendable member being a disc having a central boss;

said rigid backing member being a disc having a central aperture;

wherein said boss fits slidably into said aperture for locating said discs coaxially.

15. In a pad for closure of a wind instrument tone hole as set forth in claim 13, said bendable member being thinned maginally to facilitate bending in the area of placement of shim means.

16. In a pad for closure of a wind instrument tone hole as set forth in claim 7, including a pliant packing material on said rigid backing member for packing within a pad cup to level the entire pad against a tone hole.

17. In a pad as set forth in claim 16, said pliant material being paper rings.

18. In a pad as set forth in claim 16, said pliant material being glue, pliant when heated and becoming rigid upon cooling, for leveling said pad against a tone hole when said glue is heated to a pliant condition and subsequently cooled for rigidity.

19. In a pad for closure of a wind instrument comprising a backing disc having coaxial inner and outer collars effecting a recess therebetween;

a skin extending across said recess and immovably supported on said collars;

the exposed area of said skin being thus limited to a ringlike area stabilized by support on said collars aginst shrinkage and expansion due to ambient conditions.

20. In a pad as set forth in claim 19, said inner collar having a bore;

a screw passing through said bore to hold said pad to a pad cup and a washer clamping said skin to said inner collar and being secured by said screw;

said washer extending beyond said collar to further narrow said ringlike area and provide stability to the exposed area of said skin.

21. In a pad as set forth in claim 19, wherein said inner collar is threaded for a screw; a washer engaging said skin over said inner collar and a screw clamping said washer thereto;

said washer extending beyond said inner collar to further limit and stabilize said exposed area of said skin.

22. In a pad as set forth in claim 19, including a bore through said inner collar and a retainer ring in said bore for securing said pad to a pad cup;

said retainer ring having a radial flange extending beyond said inner collar to further limit and stabilize the exposed area of said skin.

the exposed area of said skin being thus limited to a ringlike area stabilized by support on said collars against shrinkage and expansion due to ambient conditions.

23. In a pad as set forth in claim 19, said ringlike area being disposed relative to a tone hole seat so as to be contacted thereby substantially centrally.

24. In a pad for closure of a wind instrument, as set forth in claim 19, including a cushion in said recess supporting said ringlike area.

25. In a pad as set forth in claim 19, said inner collar being thicker than said outer collar to limit the skin to a narrowed ringlike area of no more than half the radius of said disc.

* * * * *